US006010242A

United States Patent [19]

Ho

[11] Patent Number: 6,010,242

[45] Date of Patent: Jan. 4, 2000

[54] ROTARY SWITCH LASER INDICATOR

[76] Inventor: Ko-Liang Ho, No. 305, Hua Cheng Rd., Hsinchuag, Taipei Hsien, Taiwan

[21] Appl. No.: 09/039,229

[22] Filed: Mar. 16, 1998

[51] Int. Cl.[7] ..... G04B 19/30

[52] U.S. Cl. ..... 368/281; 368/10; 368/70; 368/227

[58] Field of Search ..... 368/227, 10, 223–229, 368/70, 276, 281, 282

[56] References Cited

U.S. PATENT DOCUMENTS 5,260,919 11/1993 Tsai ..... 368/227
5,838,639 11/1998 Hwang ..... 368/227

*Primary Examiner*—Bernard Roskoski
*Attorney, Agent, or Firm*—Rosenberg, Klein & Lee

[57] ABSTRACT

A rotary switch laser indicator having a casing a mirror seat, and a laser unit, that will display different images by rotating the mirror seat to control the switch. The casing can be attached to a band and the switch can be used as an indicator in the watch display.

6 Claims, 7 Drawing Sheets

ROTARY SWITCH LASER INDICATOR

BACKGROUND OF THE INVENTION

The subject matter relates to a type of rotary switch laser indicator, or more specifically, to a mechanism that functions concurrently as a watch and a laser indicator that will be able to display various images.

The laser indicator is a mechanism containing a laser device, by the emission of laser ray from the laser device, it will serve to indicate, such as the various laser indicators that had been disclosed in the domestic Patent Gazette, Ser. Nos. 299,923, 299,872, 273,943, etc.

However, with the above-mentioned conventional laser indicators, the emission of laser ray normally shows a single image (such as a round dot), so they lack variability and could not satisfy circumstances where proper change may be needed.

Moreover, a prior art of laser indicator could not be carried wherever one may travel, so it has to be put somewhere when it is not in use, so it will occupy a certain space for storage, and when before it is used, the user will have to spend some time trying to locate it, so there may be inconveniences in its operation.

SUMMARY OF THE INVENTION

The primary objective of the subject matter is to present a type of rotary switch laser indicator, comprising no less than a casing, a mirror seat and a laser unit, that will display different images by rotating the mirror seat to control the switch and rotate different mirrors, the rotary switch mechanism in the subject matter will enable convenient replacement of various images, and its operation is quite convenient.

Another objective of the subject matter is to present a rotary switch laser indicator, wherein to the front and back sides of its casing can be attached with band units, and on its casing is fixed a time display unit, in order to concurrent functions as a watch and a laser indicator, which can be used as a watch in regular hours, and before it need to be used as an indicator, all the user has to do is rotate the mirror seat, then it will emit laser ray to function as a laser indicator, therefore, it has such features as convenient portability, minimized occupation of space, operational convenience, etc.

To enable full understanding of the characteristics and technical contents of the subject matter, please refer to the following detailed description with drawings; however, the attached drawings are only for the purposes of reference and description, which shall not be based to restrict or limit the subject matter:

BRIEF DESCRIPTION OF NUMERALS

| | |
|---|---|
| 10 casing | |
| 11 accommodating chamber | 12 band unit |
| 13 screw | 14 bottom cover |
| 15 opening | 16 battery cover |
| 17 light exit | |
| 20 mirror seat | |
| 21 fixing groove | 22 mirror |
| 23 toothed surface | 24 depression |
| 25 positioning groove | 26 protrusion |
| 30 laser unit | |
| 31 laser device | 32 circuit board |
| 33 battery spring | 34 battery |
| 35 first conductive spring | 36 second conductive spring |
| 40 cover unit | |
| 41 main unit | 42 top cover |
| 43 time display | 44 positioning unit |

DETAILED DESCRIPTION OF PREFERRED EMBODIMENT

Figure 1:
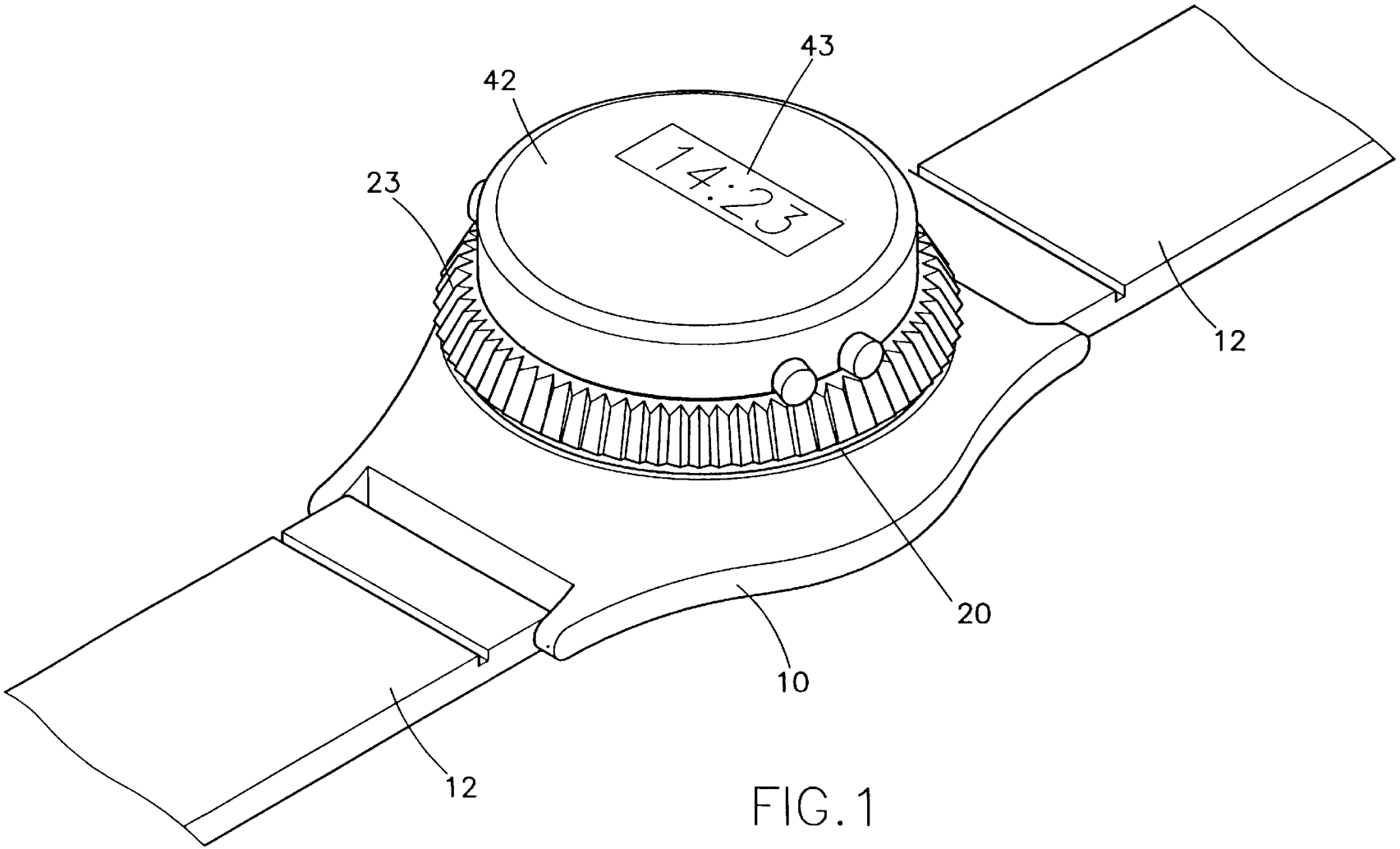
FIG. 1 is a perspective assembled view of the subject matter.
Figure 2:
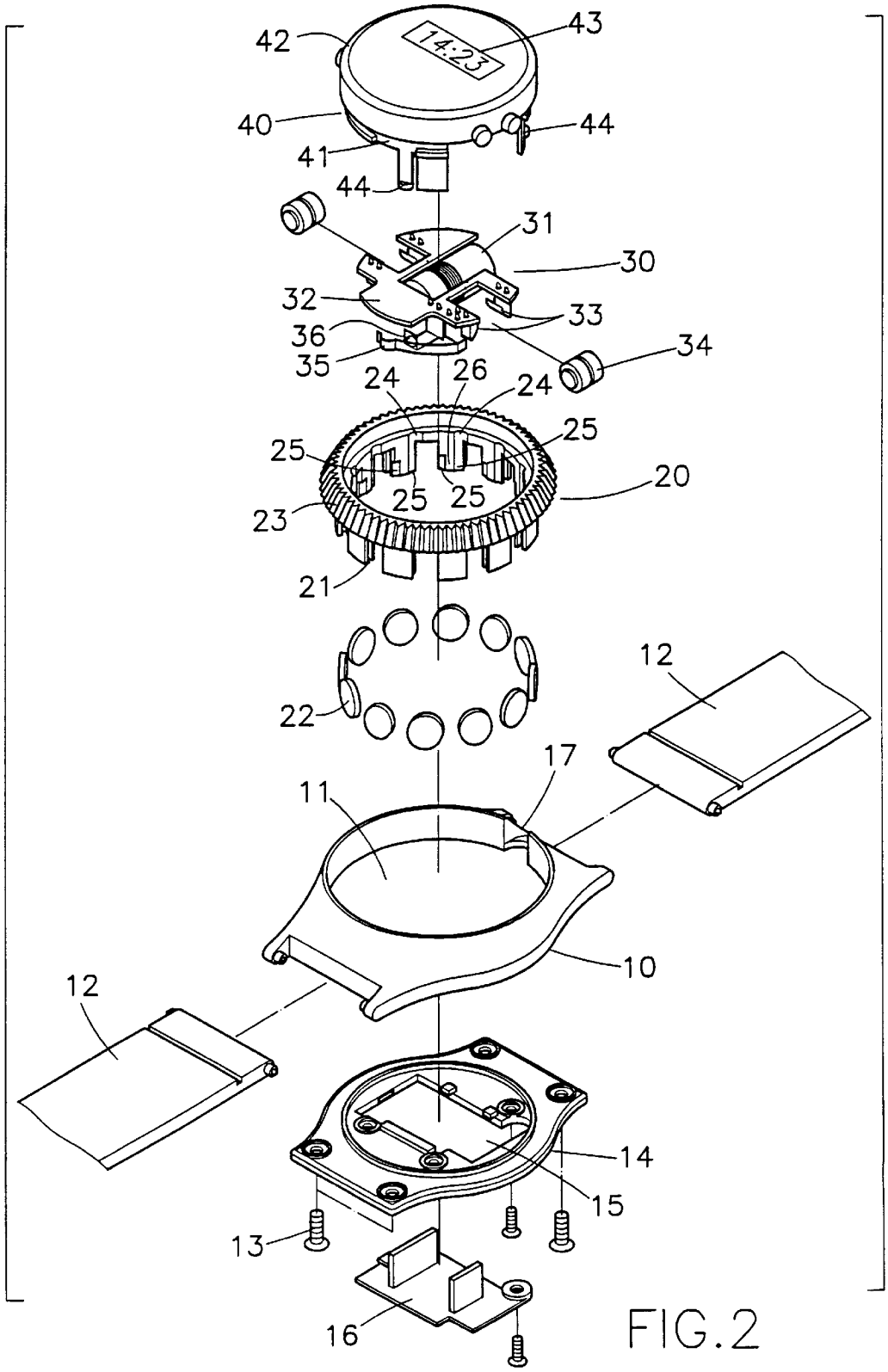
FIG. 2 is an exploded view of the subject matter.
Figure 3:
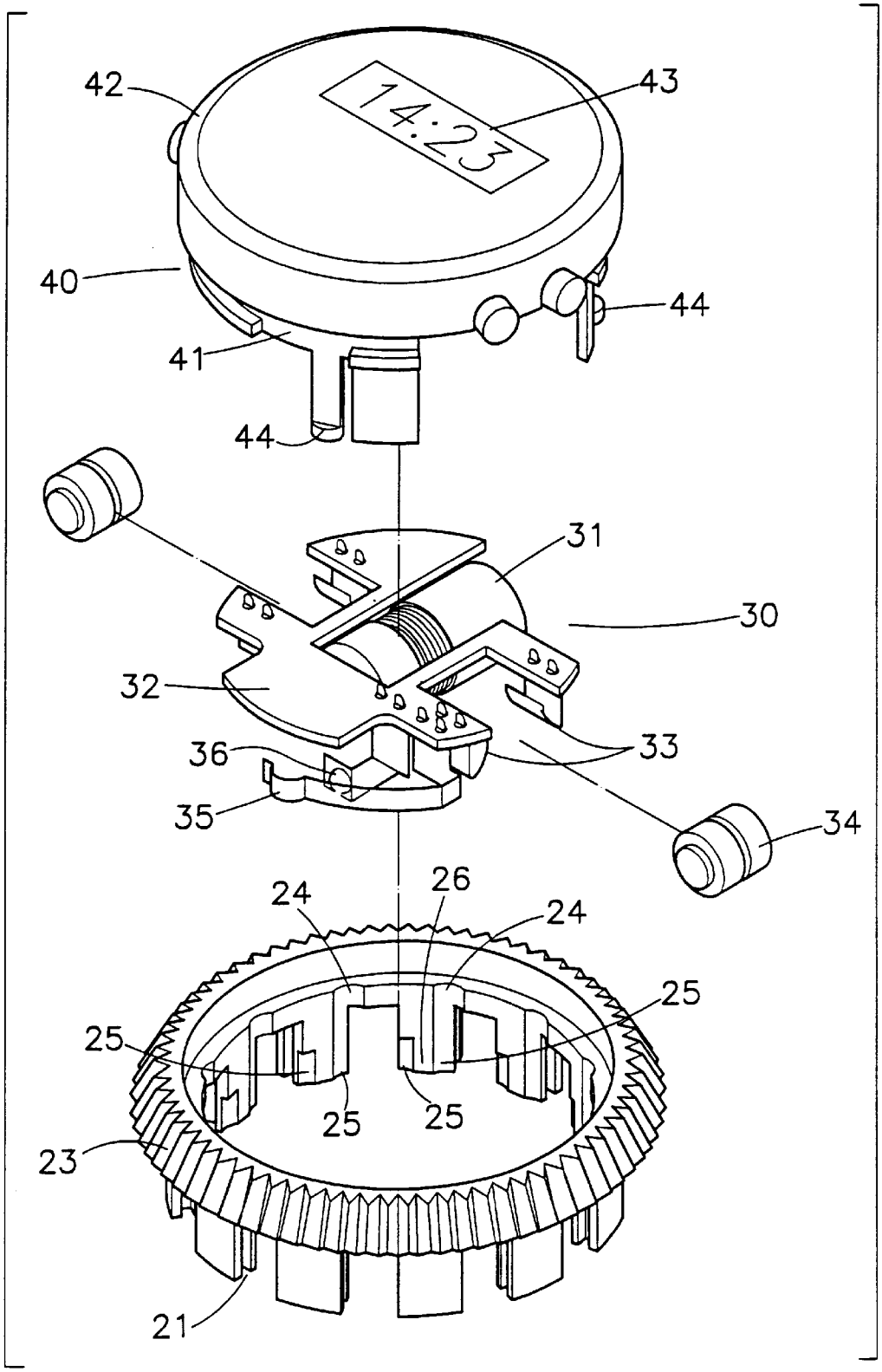
FIG. 3 is an exploded view of a portion of the subject matter.

As shown in FIGS. 1, 2 and 3, the subject matter relates to the presentation of a rotary switch laser display unit, comprising at least a casing 10, a mirror seat 20 and a laser unit 30, wherein inside the casing 10 is an accommodating chamber 11, to the front and back sides of the casing 10 can be linked with a band unit 12 to facilitate its being worn on a wrist, the bottom of the casing 10 can be sealed by a bottom cover 14 that is tightened by screws 13, the bottom cover 14 having an opening 15, said opening can be sealed by a replaceable battery cover 16, at the front side of the casing 10 is a light outlet 17.

The mirror seat 20 is a generally round unit, on its side wall and spaced at equal intervals are a number (12 pieces) of fixing grooves 21, in each fixing groove 21 is inserted a mirror 22, on the surface of each mirror 22 is a different image, so the laser ray will display different images through the mirrors 22. On the mirror seat 20 is an appropriate toothed surface 23 that enables the rotation of the mirror seat 20. On the inside wall of the mirror seat 20 and spaced at equal intervals are a number (12 pieces) of depressions 24, between two depressions 24 a protrusion 26, on the inside wall of the mirror seat 20 and spaced at equal intervals are a number (24 pieces) of fixing grooves 25. Said mirror seat 20 is properly mounted in the accommodating chamber 11 of the casing 10, the mirror seat 20 may be rotated freely, so that a specific mirror 22 may be chosen to align with the light outlet 17 on the casing 10.

Figure 4:
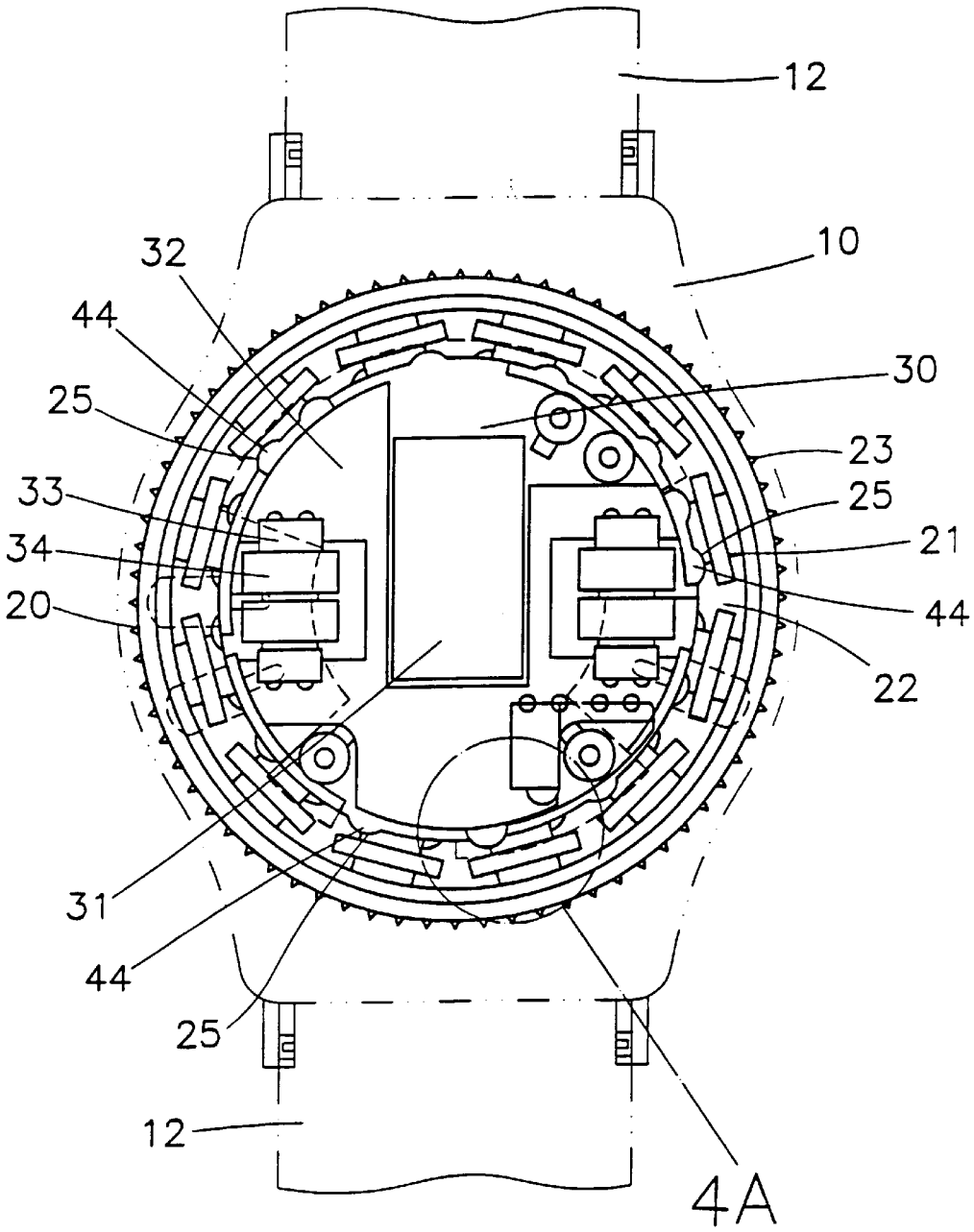
FIG. 4 is a over view of the subject matter in operation.
Figure 4A:
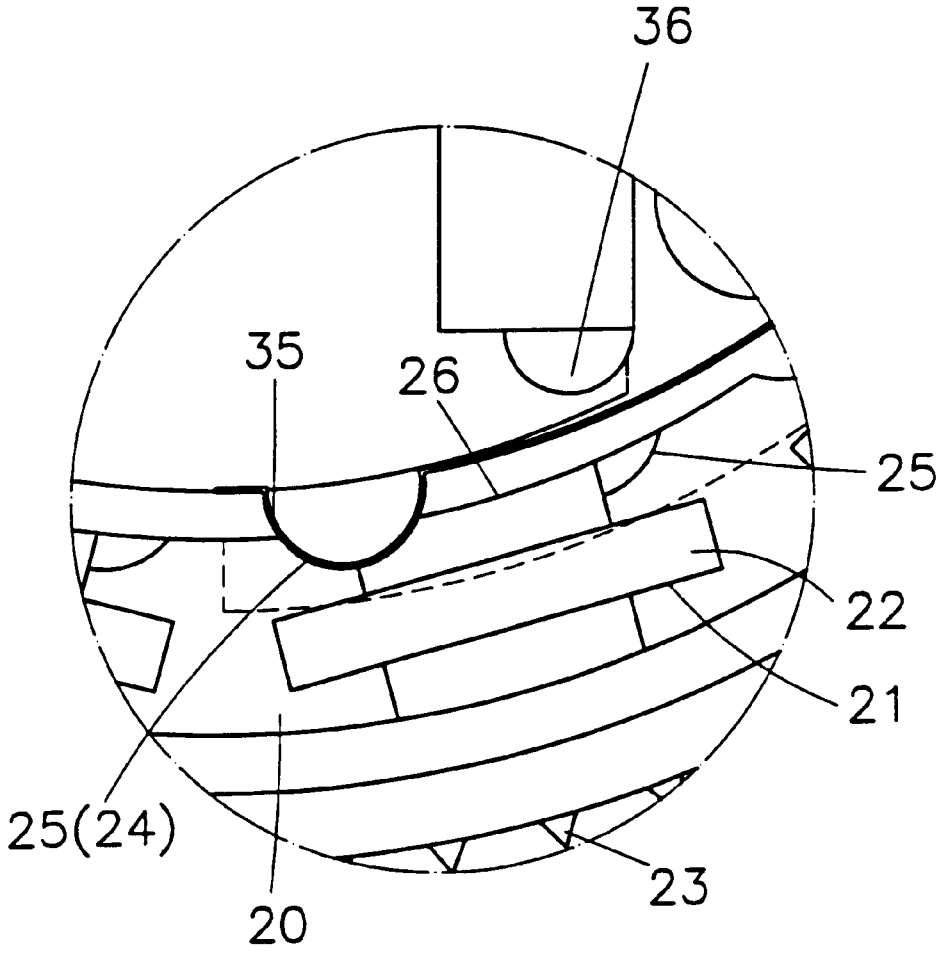
FIG. 4A is an enlarged view showing the conductive spring matched to the inside of a depression in the mirror seat.
Figure 5:
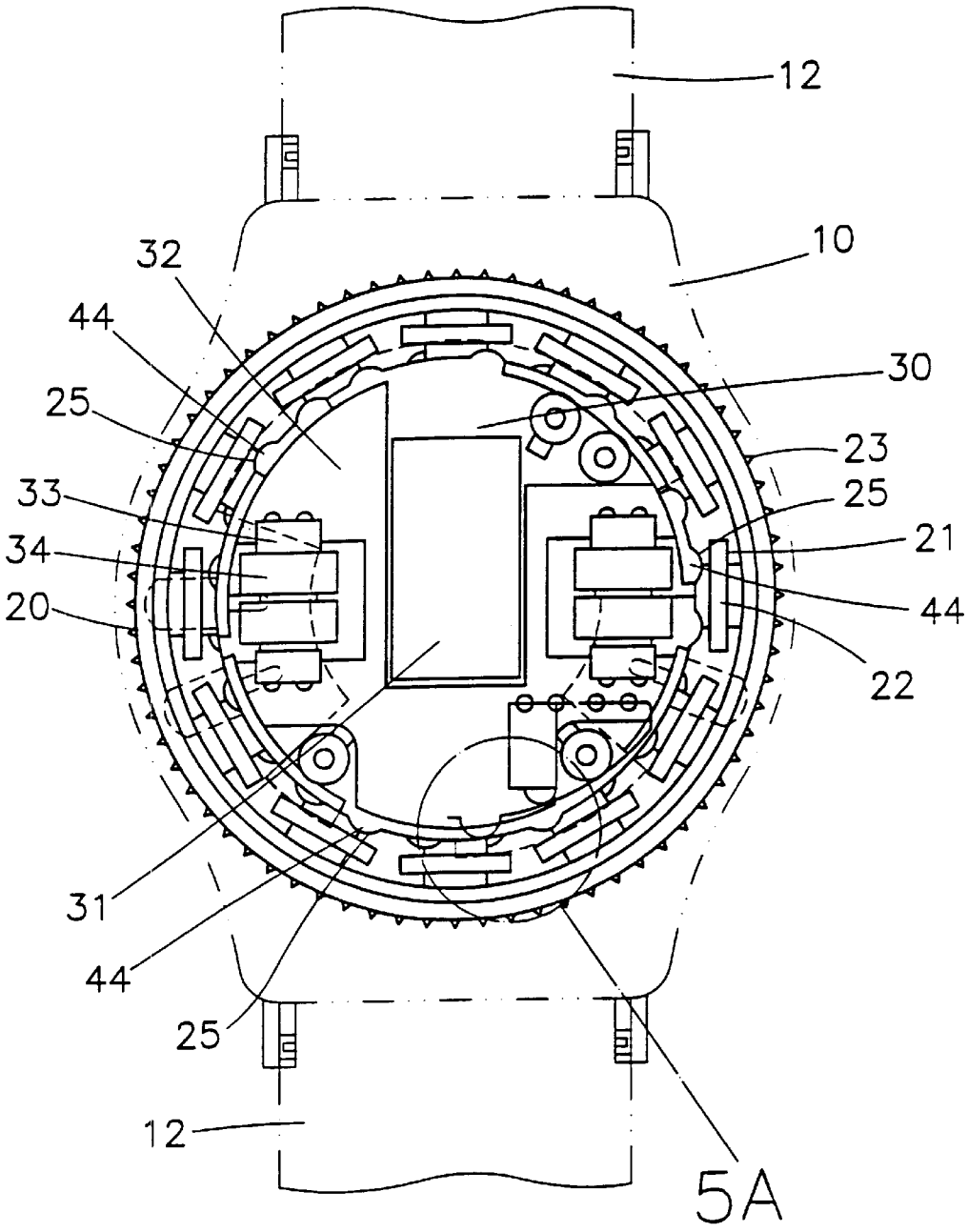
FIG. 5 is a over view of the subject matter in operation.
Figure 5A:
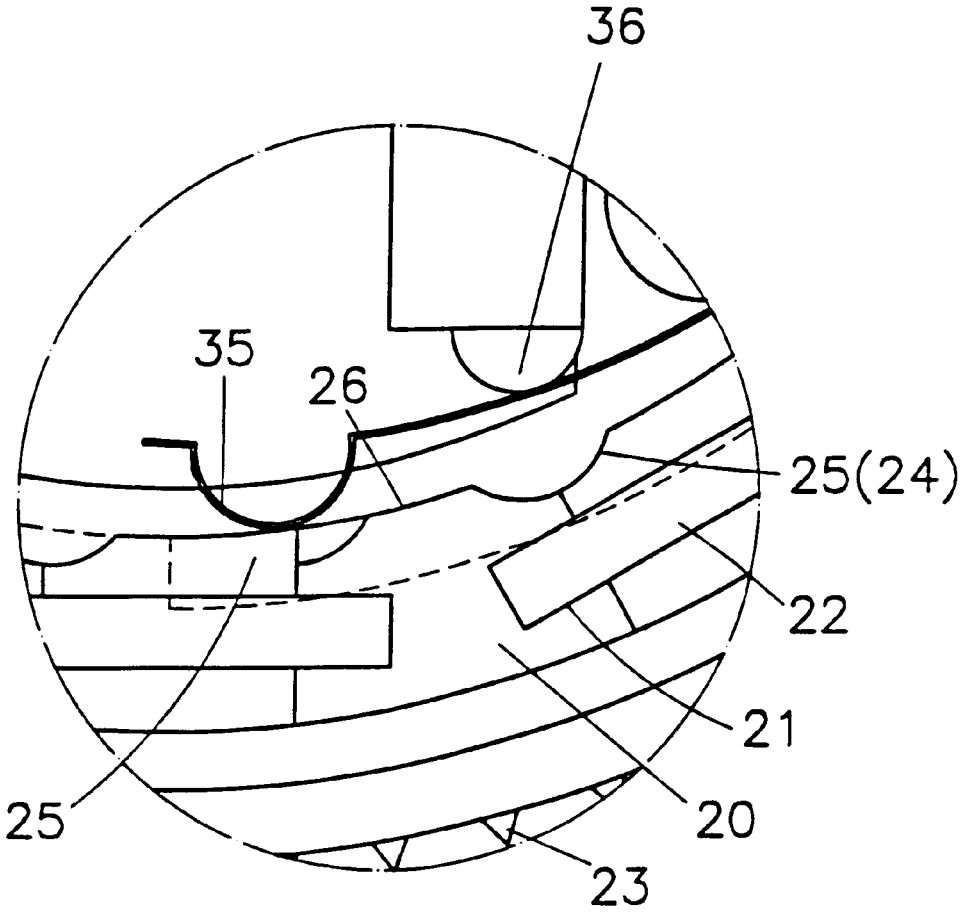
FIG. 5A is an enlarged view showing the conductive spring being matched to a second protrusion of the mirror seat.

The laser unit 30 involves a laser device 31, inside said laser device 31 is a regular laser diode (not shown in drawing), which front side can be lit by the laser ray, the laser device 31 is fixed onto a circuit board 32, on the circuit board 32 is fixed a battery spring 33, the battery 34 may be located between the battery springs 33 to provide the power required by the laser unit 30, said laser unit 30 has a switch that is composed of a first conductive spring 35 and a second conductive spring 36, said two conductive springs 35 and 36 are normally opened, so the switch is in an OFF mode. Said laser unit 30 is accommodated inside the mirror seat 20, the first conductive spring 35 of the laser unit 30 may be fitted to the depression 24 or protrusion 26 on the mirror seat 20. When the first conductive spring 35 is matched to the inside of the depression 24 of the mirror seat 20 (as shown in FIG. 4), the two conductive springs 35 and 36 are separated, so the switch is in an OFF mode; when the first conductive spring 35 is matched to the protrusion 26 of the mirror seat 20 (as shown in FIG. 5), it will push the first conductive spring 35 to contact the second conductive spring 36, so the two conductive springs 35 and 36 are in contact, and the switch is turned to an ON mode.

Also, on the casing 10 may be fixed a cover unit 40, on the bottom of said cover unit 40 are a certain number of fixing unit 44. Said cover unit 40 may be a time display unit, when the cover unit 40 functions as a time display unit, it has a main unit 41 and a top cover 42, inside the main unit 41 and the top cover 42 is a regular clock mechanism, so the time display 43 on the top cover 42 will display the time. Said cover unit 40 is accommodated inside the mirror seat 20, and is fixed to the laser unit 30, the cover unit 40, the laser unit 30 and the bottom cover 14 of the casing are fixed and joined as one unit.

The casing 10, the laser unit 30 and the cover unit 40 are fixed, and the front side of the laser device 31 of the laser unit 30 is aligned to the light outlet 17 of the casing 10, so that the laser ray from the laser device 31 may be emitted through the light exit 17, the mirror seat 20 is a rotating mobile unit, its mirrors 22 are located between the light exit 17 on the casing and the laser device 31 of the laser unit 30, so the laser ray may display the image through the mirrors 22, and with the rotation of the mirror seat 20, various mirrors 22 may be changed to display different images, and when the mirror seat 20 is rotating, the positioning unit 44 of the cover unit can match the positioning groove 25 on the inside wall of the mirror seat 20, so that when the mirror seat 20 is rotated, there will be a number of stages (24 stages) of positioned effects, so the mirror seat 20 may be positioned and the switch may be in an ON or OFF mode. When the mirror seat 20 is so positioned that the switch is in an ON mode, the two conductive springs 35 and 36 are in contact, one mirror 22 of the mirror seat 20 is correctly located between the light exit 17 on the casing 10 and the front side of the laser device 31 of the laser unit 30, so the laser ray may display the image through the mirror 22, to provide the function as an indicator. When the mirror seat 20 is so positioned that the switch is in an OFF mode, the two conductive springs 35 and 36 are separated, then the mirrors 22 of the mirror seat 20 are staggered between the light exit 17 on the casing 10 and the laser device 31 of the laser unit 30, then the display unit will not function.

With the subject matter of laser indicator with rotating switch, the laser ray may emit merely by rotating the mirror seat 20, to serve as a laser indicator, whereby different images may be displayed by the rotation of the mirror seat 20 and the control of switch and the change of mirrors 22, with such a rotating switch in the subject matter, its operation can be made quite convenient to change the display of various images.

Furthermore, in case the subject matter is attached with a cover unit 40 with time display and a band unit 12, it will serve concurrent functions as a watch and a laser indicator, serving as a regular watch in ordinary hours, and by mere rotation of its mirror seat 20, it will be used as an indicator to emit laser ray serving as laser indicator, since the subject matter has integrated a laser indicator in a mechanism just like a watch, it will achieve the features of convenient portability, minimized occupation of space and operational convenience.

Summing up, with effective improvement on conventional laser indicators that involve such shortcomings as lack of variability of images, inconvenient portability, occupation of much space, operational inconvenience, etc., the subject matter is indeed a novel creation with its novelty and originality that will fully satisfy the qualifications for a patent right, hence this application is filed in accordance with the Patent Law to protect the subject inventor's rights and interests. Your favorable consideration shall be appreciated.

It is declared hereby that the above description, covering only the preferred embodiment of the subject matter, should not be based to limit or restrict the subject claim, and that all equivalent structural and/or configurational variations and/or modifications easily conceivable to anyone skilled in the subject art, and deriving from the subject description with drawings herein shall reasonably be included in the intent of the subject claim.

I claim:

1. A type of rotary switch laser indicator, comprising at least:

a casing, containing an accommodating chamber, on said casing being a light exit, a mirror seat, being fixed with a certain number of different mirrors, said mirror seat involving a certain number of depressions that are spaced at intervals, between the depressions are protrusions, on the mirror seat are a certain number of positioning grooves spaced at equal intervals, said mirror seat being fitted inside the accommodating chamber of the casing, the mirror seat being rotated to select a specific mirror to align with the light exit on the casing;

a laser unit, comprising a laser device and a circuit board, with a battery to provide the required power, there being a switch composed of two conductive springs, said laser unit being fitted inside the mirror seat, one conductive spring of the laser unit may push against the depression or protrusion of the mirror seat, so that the two conductive springs are either separated or contacted to turn the switch to either ON or OFF mode; and a cover unit, on its bottom being a certain number of positioning units, said cover unit and the laser unit being joined as one unit, the laser unit and the casing being fixed as one unit, the front side of the laser device of the laser unit being aligned to the light exit on the casing, the mirrors on the mirror seat may be located between the light exit on the casing and the front side of the laser device of the laser unit, so the laser ray may display the images through the mirrors, and by rotating the mirror seat, different mirrors are rotated, and when the mirror seat is being rotated, the positioning unit may match the positioning grooves on the inside wall of the mirror seat, to enable positioning effect with different stages.

2. The rotary switch laser indicator, as recited in claim 1, wherein to the bottom of the casing may be fixed a bottom cover, said bottom cover involving a replaceable battery cover.

3. The rotary switch laser indicator, as recited in claim 1, wherein on the mirror seat is an appropriate toothed surface to facilitate manual rotation.

4. The rotary switch laser indicator, as recited in claim 1, wherein the front and back sides of the casing are joined with band units.

5. The rotary switch laser indicator, as recited in claim 1, wherein the front and back sides of the casing are joined with band units, while the cover unit may include a time display unit.

6. The rotary switch laser indicator, as recited in claim 1, comprising a casing, said casing involving a light exit, a laser unit that is properly fixed onto the casing, a mirror seat being mounted onto the casing and may be rotated, onto said mirror seat are fixed a certain number of mirrors, the mirrors on the mirror seat may be located between the light exit on the casing and the laser unit, so that the laser ray may display images through the mirrors, and that different mirrors are replaced by rotating the mirror seat.

* * * * *